US005803499A

United States Patent [19]

Tung et al.

[11] Patent Number: 5,803,499

[45] Date of Patent: Sep. 8, 1998

[54] PRODUCT MARKETING BOOKLET

[76] Inventors: James C. Tung, 82 Highgate La., Blue Bell, Pa. 19422; Norman Werther, 888 Welsh Rd., Horsham, Pa. 19044

[21] Appl. No.: 561,471

[22] Filed: Nov. 21, 1995

[51] Int. Cl.[6] ..... B42D 15/00

[52] U.S. Cl. ..... 283/56; 283/900

[58] Field of Search ..... 283/115, 56, 900, 283/61, 62, 116, 81; 281/2, 5

[56] References Cited

U.S. PATENT DOCUMENTS

| | | | |
|---|---|---|---|
| 2,652,149 | 9/1953 | O'Meara . | |
| 2,877,893 | 3/1959 | Volckening . | |
| 3,305,077 | 2/1967 | Grief et al. . | |
| 3,494,322 | 2/1970 | Dubbels . | |
| 3,503,493 | 3/1970 | Nagy . | |
| 3,515,265 | 6/1970 | Bartnik . | |
| 3,625,547 | 12/1971 | Burke . | |
| 3,856,144 | 12/1974 | Kelly . | |
| 3,952,942 | 4/1976 | O'Leary et al. . | |
| 3,958,693 | 5/1976 | Greene . | |
| 3,958,750 | 5/1976 | Prybeck . | |
| 4,011,985 | 3/1977 | Simson . | |
| 4,029,341 | 6/1977 | Neill et al. . | |
| 4,159,129 | 6/1979 | Lockhart . | |
| 4,189,053 | 2/1980 | Stagnitto et al. . | |
| 4,365,708 | 12/1982 | Tyus . | |
| 4,526,404 | 7/1985 | Vazquez . | |
| 4,601,490 | 7/1986 | Brandon . | |
| 4,616,852 | 10/1986 | Cash . | |
| 4,706,996 | 11/1987 | Fasham . | |
| 4,955,481 | 9/1990 | Novinski et al. . | |
| 4,976,351 | 12/1990 | Mangini et al. . | |
| 4,991,877 | 2/1991 | Lieberman . | |
| 5,022,522 | 6/1991 | Kennedy . | |
| 5,031,937 | 7/1991 | Nellhaus | 283/900 X |
| 5,046,609 | 9/1991 | Mangini et al. . | |
| 5,048,870 | 9/1991 | Mangini et al. . | |
| 5,076,490 | 12/1991 | Dulin . | |
| 5,096,058 | 3/1992 | Juravin et al. . | |
| 5,174,451 | 12/1992 | Niven . | |
| 5,178,419 | 1/1993 | Bolnick . | |
| 5,181,743 | 1/1993 | Lloyd . | |
| 5,199,662 | 4/1993 | Klupt . | |
| 5,209,349 | 5/1993 | Porter et al. . | |
| 5,232,248 | 8/1993 | Talbott . | |
| 5,242,055 | 9/1993 | Pora . | |
| 5,261,702 | 11/1993 | Mayfield | 283/115 |
| 5,324,077 | 6/1994 | Kessler et al. . | |
| 5,328,208 | 7/1994 | Garrison . | |
| 5,342,094 | 8/1994 | Duck . | |
| 5,361,897 | 11/1994 | Poehler . | |
| 5,370,223 | 12/1994 | Leicht, Jr. . | |
| 5,390,796 | 2/1995 | Kerfoot, Jr. . | |
| 5,393,100 | 2/1995 | Coe | 283/900 X |

*Primary Examiner*—Willmon Fridie, Jr.

*Attorney, Agent, or Firm*—Caesar, Rivise, Bernstein, Cohen & Pokotilow, Ltd.

[57] ABSTRACT

A product marketing booklet that enables a company or a designated representative to communicate with other persons involved in the distribution and/or use of products, including the physician, the patient and the pharmacist. The marketing booklet includes a first multi-panel unit having panels movable relative to each other between an opened condition in which the panels are spaced transversely from each other and a folded, collapsed condition in which the panels overlie each other. A second multi-panel unit includes panels movable relative to each other between an opened condition in which the panels are spaced transversely from each other and a folded, collapsed position in which the panels overlie each other. Attachment means are provided for removably securing the first and second units to each other with the second unit overlying at least a portion of the first unit in a position for permitting the panels of both the first and second units to be maintained either in the opened condition or in the folded, collapsed condition to form a multi-panel booklet. One of the multi-panel units includes information and/or product samples intended to be given to a recipient (e.g., a patient), and the other multi-panel unit is intended to be retained by the physician and includes information-containing substrates that can be secured to a patient's chart.

57 Claims, 5 Drawing Sheets

PRODUCT MARKETING BOOKLET

BACKGROUND OF THE INVENTION

This invention relates generally to the field of product marketing and more particularly to the field of marketing medical products (e.g., pharmaceutical products). In particular, this invention relates to a unique product marketing booklet intended to improve communications among the various entities involved in the distribution chain for the product, as well as with the end user of the product.

Various devices for marketing and testing pharmaceutical products are known. U.S. Pat. No. 3,625,547 (Burke) discloses a composite prescription form comprising five individual parts, including a detachable part to be used as a prescription label, another which is used as a stack label, a third part constituting the prescription, a fourth part which is a copy of the original prescription and a fifth part secured to the patient's prescription ledger card. This form is intended to reduce the average amount of time used by pharmacists in filling a prescription.

U.S. Pat. No. 5,178,418 (Bolnick) comprises a multi-segment form with labels. The first and second label segments contain information identifying the patient participating in a drug study, the drug being tested and other study information. The third label contains hidden information on whether the particular patient has been prescribed a drug or a placebo. The hidden information may be uncovered by the physician if the patient's condition deteriorates.

U.S. Pat. No. 4,526,404 (Vasquez) discloses a label bearing container holding clinical products such as blood products. The label can be removed and attached to the patient's chart to indicate that the clinical product was administered to the patient.

Various other devices for marketing products are known including a prescription form which incorporates a sample of the drug to be administered; as well as other composite marketing devices, such as those used in the sale of photographic film, which incorporate a mailer to return the exposed film to the company for processing.

However, the prior art does not disclose a marketing device and system which is capable of establishing and maintaining effective communications between the pharmaceutical company or its designated representative, e.g., a marketing company or a database company, and the physician, patient, pharmacist, and managed care/insurance companies, involved in the prescribing, use, and dispensing, respectively, of a drug or other medically-related product.

In applicants' earlier-identified U.S. application Ser. No. 08/439,730, the subject matter of which is hereby incorporated by reference herein, unique devices are disclosed for enhancing communications among the prescriber of a medical product (e.g., a health care provider such as a physician), a recipient or user of that product (e.g., a patient), a manufacturer of the product (e.g., a pharmaceutical company), and/or insurance company/managed care company, and a dispenser of the product (e.g., a pharmacist). These devices include multiple segments that are separable from each other. One segment can include product-specific information (which can be attached to a patient's chart by a treating physician). An additional segment can include a free sample of the product. A further additional segment can include a mailer addressed to the manufacturer of the product or to the manufacturer's agent or insurance company or managed care company. This mailer includes locations in which a health care provider or dispenser of the product can provide medically-related information about the recipient or intended recipient of the product. This mailer also can instruct a pharmacist to dispense a specified quantity of the product to a patient free of charge or at a discount, and can advise the pharmacist that the specified quantity will be reimbursed to him upon receipt of the mailer by the manufacturer of the product or by the manufacturer's agent.

Although the multi-segment communication devices described and claimed in applicants' co-pending '730 application are considered to be effective for enhancing communications among entities involved in providing health care services and products, applicants invented an improved communication device having a number of additional capabilities that are not possessed by the communication devices described and claimed in the aforementioned '730 application. The improved device is described and claimed in U.S. application Ser. No. 08/504,632, and the subject matter of this latter application is hereby incorporated by reference herein.

The communication device described in the '632 application has the capability of communicating disease state management information (e.g., general and specific information regarding the disease being treated) to a health care provider (e.g., a physician) and providing continued easy access to such information by the health care provider. In addition, the communication device described in the '632 application has the capability of minimizing or eliminating the dispensing of excessive quantities of free samples of a product by a health care provider (e.g., a physician) to a recipient (e.g., a patient), and also includes two separate prescriptions to permit the recipient to obtain an immediate supply of a prescription product from his or her pharmacist, and also to obtain additional supplies of the product from mail order companies, generally at a substantial cost reduction compared to the price charged by a neighborhood, or local pharmacist.

Although it is applicants' belief that the various marketing devices disclosed in the '730 and '632 applications will provide effective communication among the various individuals involved in the chain of distribution and use of medically related products, it is believed that a need still exits for an improved communication device having additional capabilities/benefits that are not possessed by the communication devices described and claimed in the aforementioned '730 and '632 applications.

In particular, a need is believed to exist for an improved marketing device which is more compact in construction than the devices disclosed in applicants '730 and '632 applications, that more clearly identifies the portions of the device to be retained by the health care provider (e.g., the physician) and provided to the recipient (e.g., the patient), and that includes an improved prescription format to reduce the possibility that a dispenser of the product (e.g., pharmacist) will improperly fill the prescription.

Although applicants specify in the '730 and '632 applications that the communication devices disclosed therein could be in the form of a booklet, which clearly would reduce the overall size of the devices, this application more clearly defines the booklet format and conforms to the original concept to achieve the various objects that are met in accordance with the present invention.

SUMMARY OF THE INVENTION

The above and other objects of this invention are achieved in a product marketing booklet having first and second multi-panel units. Both units include panels that are movable relative to each other between an opened condition in which the panels of each unit are spaced transversely from each other and a folded, collapsed condition in which the panels of each unit overlie each other. The booklet includes attachment means for removably securing the first and second units to each other with the second unit overlying at least a portion of the first unit in a position for permitting the panels of both the first and second units to be maintained either in the opened condition, or in the folded, collapsed condition to form a multi-panel booklet.

In one form of the invention, the panels of one of the units include upper sections that extend beyond upper edges of the panels of the other unit, and these upper sections are exposed to view when the panels of both the first and second units are maintained either in an opened condition or in a folded, collapsed condition. Most preferably, the panels of both the first and second units are substantially the same height, and one of the units is vertically offset relative to the other unit to provide the exposed upper sections.

In the most preferred form of this invention, the front and back panels of the booklet are provided by panels of the first unit; most preferably by adjacent panels of said first unit. The remaining panels of the first unit and all of the panels of the second unit are inside panels of the folded booklet construction. Most preferably, the panels of the second unit are offset with respect to the panels of the first unit so that upper sections of the panels of the second unit are exposed to view.

In a preferred form of the invention, the booklet is employed for use in marketing a medical product, and more specifically a pharmaceutical product. In this form of the invention the first multi-panel unit is intended to be given to the recipient (e.g., the patient), and for that purpose is separable from the second multi-panel unit. The second multi-panel unit is intended to be retained by the health care provider (e.g., the physician), and most preferably includes removable substrates that can be placed on a patient's medical chart, and that provide information relating to the product and/or to the treatment of a condition for which the product is intended to be employed.

In the most preferred form of the invention, the first unit, which is intended to be given to the recipient (e.g., the patient) also includes a sample of the product to be dispensed as well as a removable coupon or bank check to provide a discount to the patient for the filling of the first prescription written by the physician.

In order to facilitate the writing of the prescription, the preferred form of the booklet of this invention includes at least one, and preferably two, removable, preprinted prescription substrates retained on one of the panels of the unit intended to be given to the patient. Prior to giving this unit to the patient the preprinted prescription substrates can be removed (e.g., peeled off of a release surface of the unit) and placed on the physician's standard prescription form. Alternatively, the preprinted prescription substrates can be fully preprinted standard prescription forms to be given directly to the patient.

In accordance with a further preferred feature of this invention, the preprinted prescription substrates, whether in a fully preprinted standard prescription form or in a partially preprinted form intended to be attached to a physician's standard form, is unique in that it includes a visual representation of the prescribed product; most preferably a visual presentation of both the front and back of that product (e.g., when the product is a tablet). Providing a visual indication of the product in conjunction with clearly presented preprinted information relating to the product to be dispensed and the manner in which the product should be taken greatly reduces the likelihood that a pharmacist will improperly fill the prescription or incorrectly advise the patient regarding the manner in which the prescription item should be taken. This visual presentation of the prescribed product features is, or can be generated by printing or by electronic generation of the prescription via specialty computer software.

In accordance with a further feature of this invention the first unit of the booklet, which is intended to be retained by the physician, also includes a substrate with formulary information advising which health care insurers will reimburse the patient for the specific product sampled in the booklet. Most preferably, this formulary information is part of a peel-off substrate that can be attached to a patient's chart, along with one or more other peel-off substrates providing information relating to the product and providing information relating to the treatment of a condition for which the product is intended to be employed or providing only disease management guidelines/protocol.

In the most preferred form of this invention, the first multi-panel unit, which is intended to be given to the recipient, includes, in addition to a product sample and coupon or bank check, educational information relating to the product and/or to the condition to be treated by the product, and a patient questionnaire in the form of a mailer addressed to a provider of the product (e.g., the manufacturer of the product or his agent).

In the most preferred form of this invention the coupon, the return mailer, and the preprinted prescription substrates, whether in a partial or fully preprinted format, are provided with a code identifying the health care provider (e.g., the physician, group practice, group of physicians, etc.) to whom the marketing booklet initially was provided. This enables the producer of the product to monitor the distribution of the product samples by specific physicians, and to correlate that information with prescriptions written by that physician for the product and questionnaires completed by the recipients of the product sample.

DESCRIPTION OF THE DRAWING

Other objects and many of the attendant advantages of this invention will readily be appreciated as the same becomes better understood by reference to the following detailed description when considered in connection with accompanying drawings wherein.

DETAILED DESCRIPTION OF THE PREFERRED EMBODIMENTS

Figure 1:
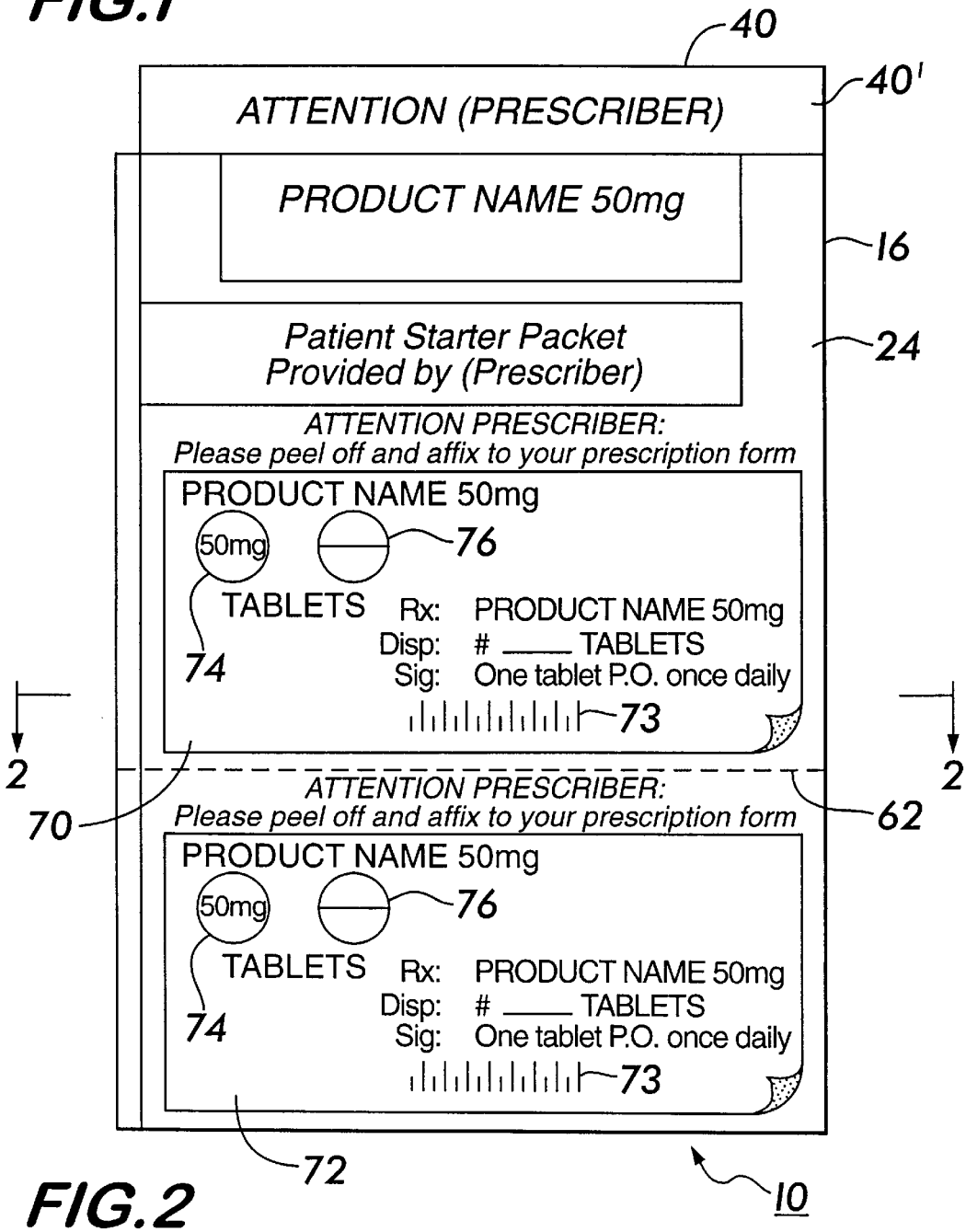
FIG. 1 is a front elevational view of the product marketing booklet in accordance with this invention, showing the booklet in its folded, collapsed condition.

Referring now in greater detail to the various figures of the drawings, wherein like reference characters refer to like parts, a product marketing booklet 10 employing the present invention is generally shown at 10 in the various figures. In accordance with the preferred embodiment of this invention the product marketing booklet is designed for use in marketing prescription or over-the-counter medical products. However, in accordance with the broadest aspects of this invention the product marketing booklet can be designed for marketing a wide variety of products, including those that are not in the medical field. However, it is envisioned that the most common uses of the marketing booklet of this invention will be in connection with the marketing of prescription or over-the-counter (brand and/or generic) pharmaceutical/medical products, as well as other types of medical products.

It also should be understood that although the device 10 illustrated in the drawings includes specific information/material, as will be described hereinafter, in accordance with the broadest aspects of the invention the specific content of the marketing booklet can be varied. For example, and not by way of limitation, if the product being marketed is not a prescription product, then there is no need for the booklet to include any removable segments in the form of prescriptions. Also, in certain forms of the invention a free product sample section may not be included, and instead a check or coupon segment may be included. Furthermore, in certain forms of the invention a panel including disease state management guidelines/protocol information may not be included and in other forms of the invention both a free product sample and a check or coupon segment may be omitted.

Figure 2:
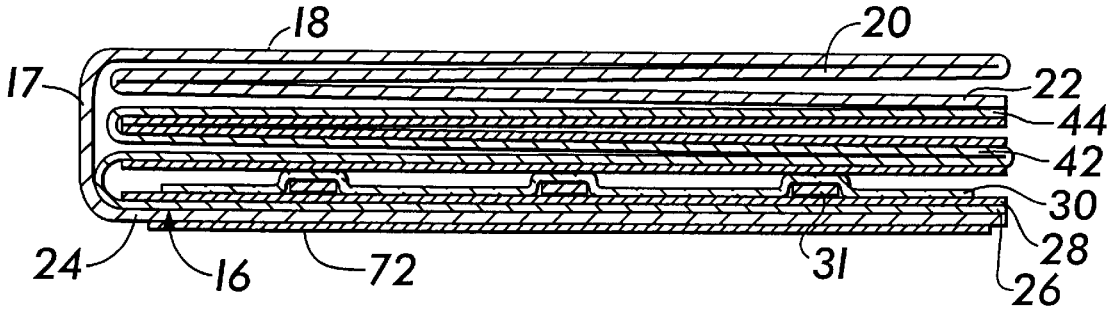
FIG. 2 is an enlarged sectional view taken along line 2—2 of FIG. 1.
Figure 3:
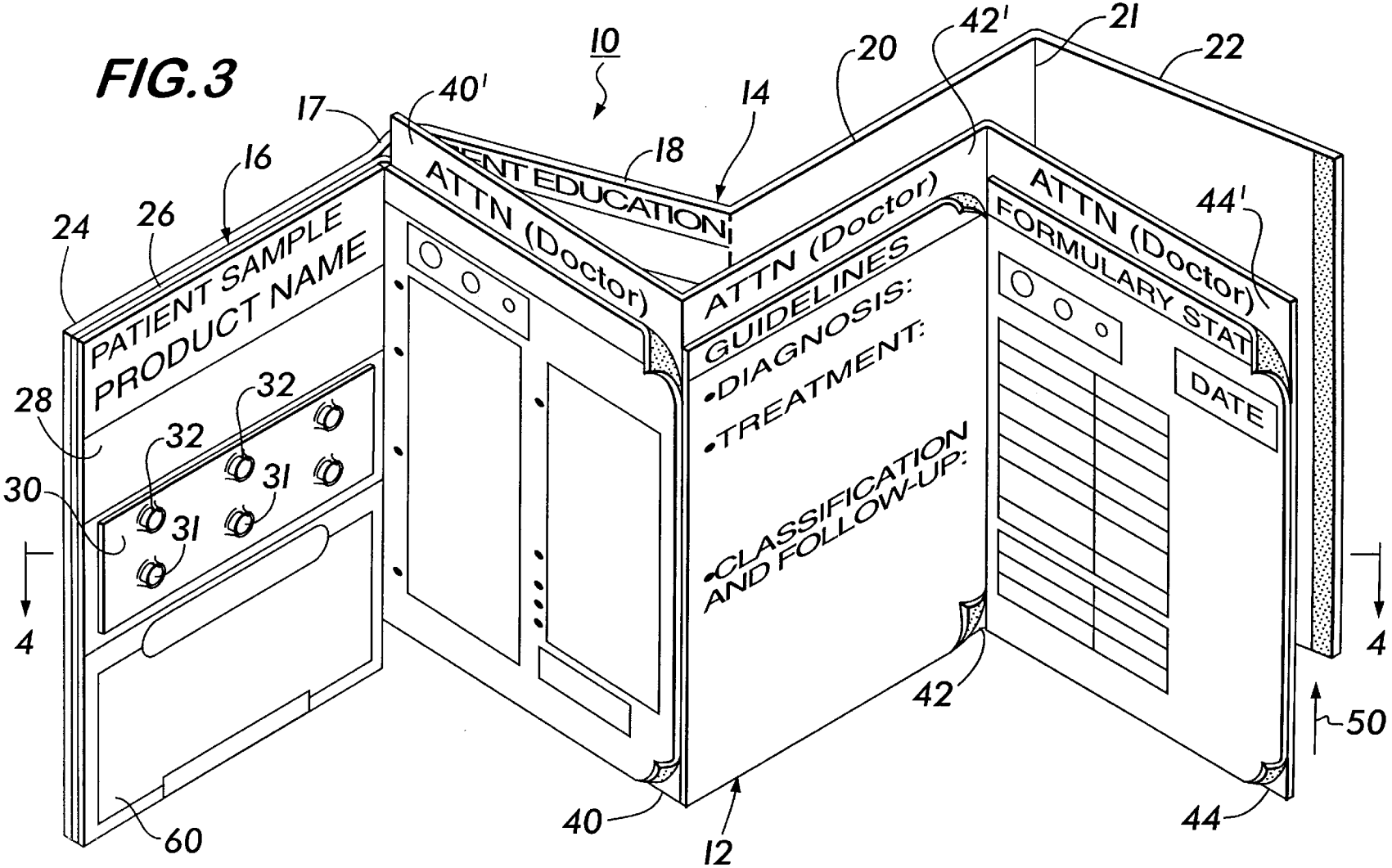
FIG. 3 is an isometric view of the booklet shown in FIG. 1, but with the various panels of the booklet partially opened to show details of construction.
Figure 4:
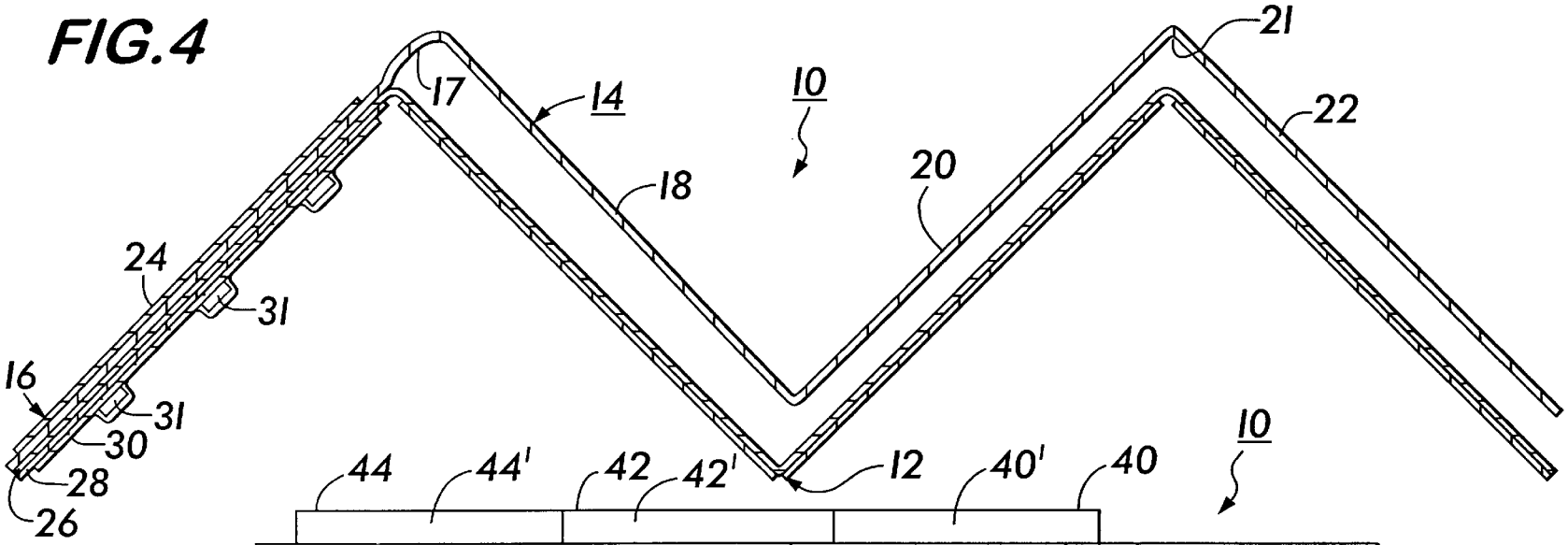
FIG. 4 is an enlarged sectional view taken along line 4—4 of FIG. 3.
Figure 5:
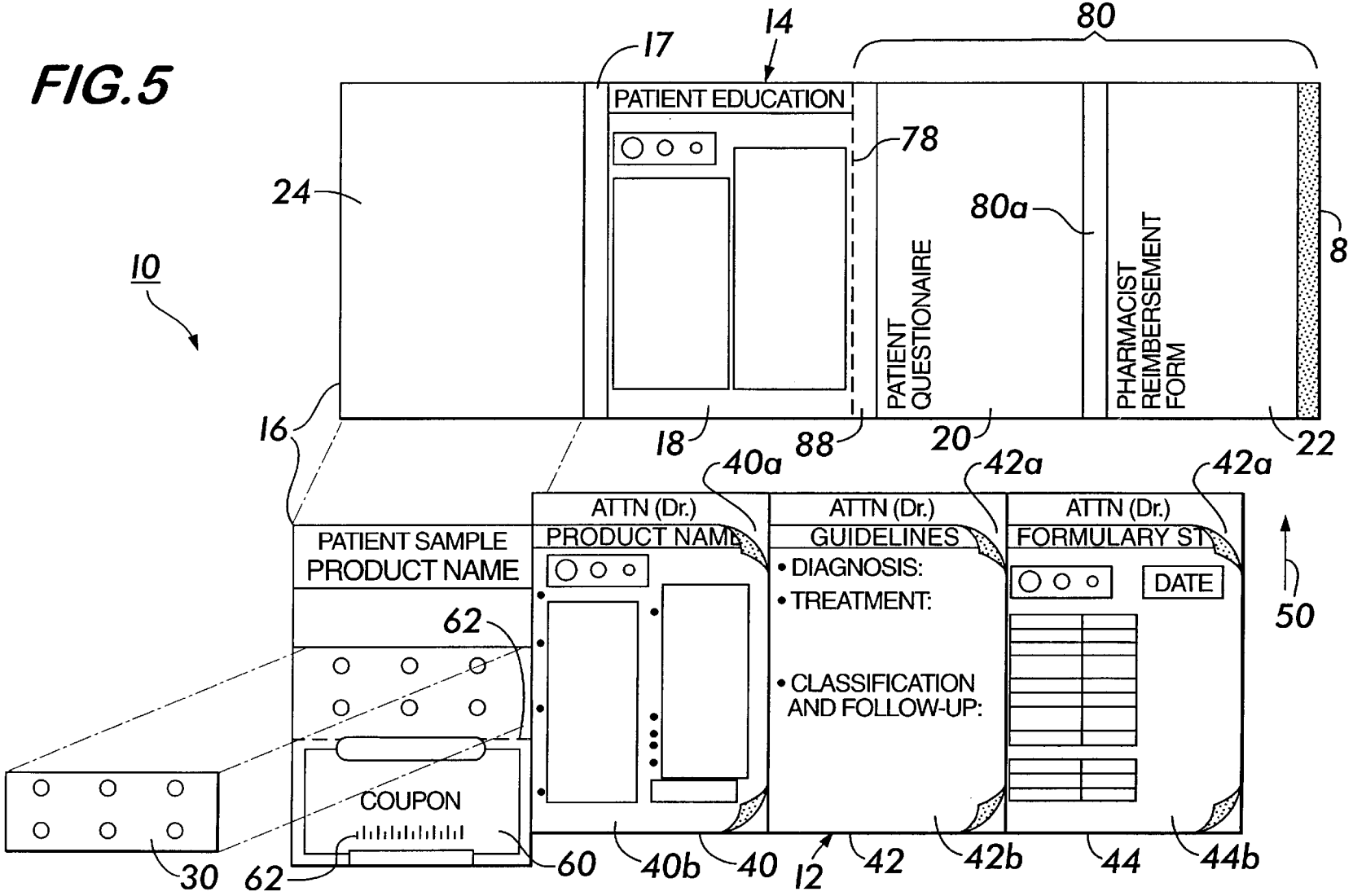
FIG. 5 is an exploded isometric view of the booklet of FIG. 1 showing the first and second multi-panel units of the booklet.

Turning now to the figures, and specifically to FIGS. 3 through 5, the marketing booklet 10 includes an inner multi-panel unit 12 secured to, but separable from an outer multi-panel unit 14. The outer unit 14 includes four panels 16, 18, 20 and 22, which are intended to be given to a recipient (e.g., a patient). The panel 16 forms the front cover of the booklet when the panels are in a folded, collapsed condition (FIG. 2), and is of a multi-layer construction as will be described in greater detail hereinafter. The panel 18 is connected to the panel 16 by an expanded hinge section 17, and this panel 18 constitutes the rear or back cover of the booklet when the panels are in the folded, collapsed condition, as is shown clearly in FIG. 2. The panels 20 and 22, which are inside panels of the folded booklet 10, are interconnected to each other through a hinge line 21, which preferably is thinner than the thickness of the panels 20 and 22. The panel 20 is connected to the panel 18 through a line of perforations 78 to permit the panels 20, 22 to be separated from the booklet 10 as a single unit, for reasons that will be described in greater detail later in this application.

Referring specifically to FIGS. 3 and 4, the front, multi-layer panel 16 includes an outer substrate, or member 24, an intermediate substrate, or member, 26, and an inner substrate 28. The outer substrate, or member, 24 constitutes the outer wall of the front panel 16. The intermediate substrate, or member, 26 constitutes an extension of the separable, inner multi-panel unit 12, and is adhesively secured between the outer substrate 24 and the inner substrate 28 to thereby secure the inner multi-panel unit 12 to the outer multi-panel unit 14. The inner substrate 28 constitutes the rear closure of a package for the product being sampled. Specifically, a plastic blister 30 is secured to the inner substrate 28 with a suitable adhesive for housing a sample quantity of pills or capsules 31 within the blister compartments 32 formed between the plastic blister 30 and the inner substrate 28.

Referring specifically to FIGS. 3–5, the inner multi-layer unit 12 includes three interconnected panels 40, 42 and 44, which are movable relative to each other between an opened condition in which the panels are spaced transversely from each other, as is illustrated in FIGS. 3 and 5, and a collapsed condition in which the panels overlie each other within the confines of the outer panels 16 and 18 of the outer unit 14, as is illustrated most clearly in FIG. 2.

The three panels 40, 42 and 44 constituting the inner multi-layer unit 12 can be separated as a single unit from the intermediate substrate 26 of the front panel 16 along a line of weakness at the junction of the panel 40 with the intermediate substrate 26 of the front panel.

Referring to FIGS. 4 and 5, each of the panels 40, 42 and 44 includes a rear substrate 40*a*, 42*a* and 44*a*, respectively, having an inner release surface to which peel-off substrates 40*b*, 42*b* and 44*b*, respectively, are removably secured through a suitable adhesive.

Figure 6:
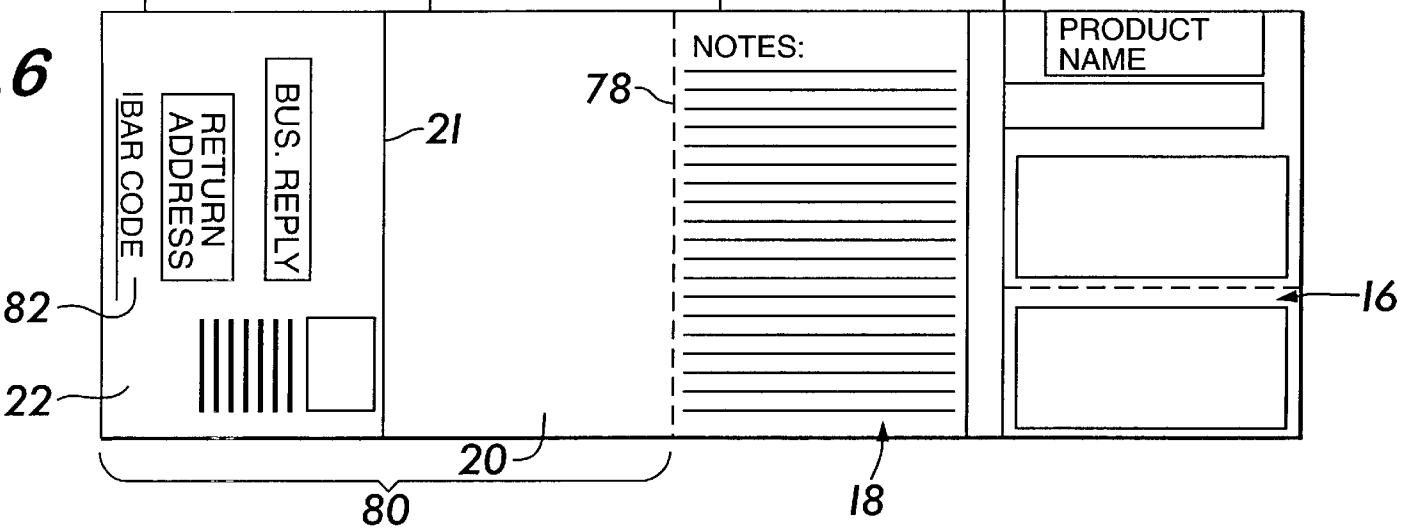
FIG. 6 is a rear elevational view of the booklet with the panels in a completely opened condition.

Referring to FIGS. 3, 5 and 6, each of the panels 40, 42 and 44 has an upper section 40', 42' and 44' extending vertically beyond upper edges of the panels 16, 18, 20 and 22 of the outer unit 14. These upper sections are exposed to view, even when the booklet is in a collapsed, folded condition, and includes written indicia specifically directing the physician's attention to the panels of the inner unit 12. This is a very desirable feature since it clearly and specifically identifies the inner unit 12 as the one that is to be retained by the physician.

As can be seen most clearly in FIGS. 3 and 5, the panels, 40, 42 and 44 of the inner unit 12 are all aligned in the transverse direction, and the unit 12 is vertically offset from the unit 14 in the direction of arrow 50 to thereby cause the upper sections 40', 42' and 44' to project above the upper edges of the panels of the outer unit 14. In this preferred construction all of the panels of the outer unit 14 and the inner unit 12 are formed of substantially the same vertical dimension. This may be desirable for ease of manufacturing, since only a single die or writing assembly needs to be provided to die cut all of the panels. However, it should be understood that the panels 40, 42 and 44 of the inner unit 12 could be designed to have a greater overall vertical dimension than the panels of the outer unit 14, in which case the inner panels would not need to be vertically offset from the outer panels in order to provide exposed upper sections 40', 42' and 44'.

Referring specifically to FIGS. 3 and 5, the preferred content of the three inner panels 40, 42 and 44 will now be described. The removable, or peel-off substrate 40*b* of the panel 40 includes product information, and is intended to be peeled-off of the rear substrate 40*a* and placed on a patient's chart. The product information included on the substrate 40*b* can be identical to that specified in both applicants' '730 and '632 applications, the subject matter of which already has been incorporated by reference herein. In particular, the substrate 40*b* includes information regarding a specific product for treating a disease, and generally the product which is being sampled in the booklet. Such detailed information can include recommended doses; possible side effects; adjustments to be made in the dosage in light of specific outcomes; side effects; etc.; adjustments to be made in diet in the event of certain side effects; etc. In general, the product information substrate 40*b* includes information taken from the Physicians Desk Reference and/or product package insert and/or other FDA (Food and Drug Administration) approved sources. In fact, the product information substrate 40*b* can include the same identifying indicia as the product information segment 20 described in applicants' aforementioned '632 application or the product information segment 4 described in applicants' aforementioned '730 patent application. The subject matter of both the '632 application and '730 application already has been incorporated by reference herein. Most preferably, the peel-off substrate 40*b* also includes indicia instructing the physician (or other health care provider) to attach the substrate 40*b* to a patient's medical chart.

Still referring to FIGS. 4 and 5, the peel-off substrate 42*b* forming part of panel 42 is directed to disease state management, and, like the substrate 40*b*, is intended to be attached to a patient's chart. The peel-off substrate 42*b* includes information with respect to a particular disease (e.g., the disease for which a sample product is being given to the patient), rather than to any one product for use in treating the disease. In particular, certain disease state management protocols exist for a number of diseases, such as asthma, hypertension and diabetes, and such protocols will be developed for other diseases. These protocols include general and specific information and developed algorithms regarding a number of factors, such as procedures for screening for the disease, for diagnosing the disease and for treatment of the disease, including, when appropriate, dietary restrictions, exercise protocol, acceptable medications under varying conditions of the disease, (e.g., mild symptoms or attack, severe attack, etc.). Most preferably the peel-off substrate 42*b* containing the disease state management information includes indicia instructing the physician or other health care provider to attach the substrate 42*b* to the patient's chart. It should be understood that the peel-off substrate 42*b* can include all of the information presented on the removable segment 12 of the marketing device described in applicants' '632 application.

Still referring to FIGS. 3 and 5, the third panel 44 of the inner unit 12 includes the formulary status of the drug on the peel-off substrate 44*b* thereof. Specifically, the formulary status identifies which of the major health care insurers or managed care providers will provide reimbursement for the specific product being marketed through the booklet 10. Based on this information, the health care provider (e.g., the physician) can determine whether to prescribe a specific product for a patient based, in part, upon whether the patient is insured by a company that will provide reimbursement for that product. Like the segments 40*b* and 42*b*, the segment 44*b* can include instructions advising the physician to attach the formulary status information to a patient's chart.

Still referring to FIGS. 3 and 5, the content of the various panels 16, 18, 20 and 22 making up the outer multi-panel unit 14 will now be described. As explained earlier, the inner substrate 28 of the front panel 16 cooperates with the plastic blister 30 to form a package for the sample pills, capsules, etc. being marketed through use of the booklet 10. The lower portion of the front panel 16 is in the form of a removable coupon 60 or bank check (not shown). This coupon is removably attached to the remainder of the front panel 16 through a line of perforations 62, and can be presented by the patient to the pharmacist along with the prescription for the product, thereby providing a discount to the patient. This coupon 60 preferably includes a bar code 62 identifying the physician or other entity to whom the booklet 10 was given. If a bank check is included in the booklet in place of the coupon 60 it can be in the exact form disclosed in applicants' copending application Ser. No. 08/504,632, the subject matter of which already has been incorporated by reference herein.

As an alternative construction, coupon 60 could be in the form of a separable, peel-off substrate retained by a suitable adhesive to a release surface of the inner substrate 28 of the front panel 16. The specific manner of affixing the coupon 60 as part of the front panel 16 is not considered to be a limitation on the broadest aspects of the present invention.

Referring to FIG. 1, the outside surface of outer substrate 24 of the front panel 16 includes an identification of the product being sampled, the name of the prescriber (e.g., physician) to whom the booklet 10 is given, and a pair of preprinted, peel-off prescription substrates 70 and 72. These prescription substrates are secured through a suitable adhesive to a release surface of the outer substrate 24 of the front panel 16.

The preprinted peel-off prescription substrates 70, 72 are a unique feature of the present invention, and include preprinted information identifying the product and dosage to be dispensed and the manner in which the product should be taken by the recipient. In addition, a space is provided for the physician to identify the number of tablets to be dispensed by the pharmacist, and a bar code 73 is provided identifying the physician to whom the booklet 10 was given. A unique feature of the prescriptions 70 and 72 is that a picture or photograph is provided that shows the exact appearance (e.g., size, color, and other markings) associated with each side of the tablet. This picture can be generated by photographic means, printing, or by electronic means utilizing specialty computer software. As illustrated, one side of the tablet 74 includes identification that it is a 50 mg. tablet and the other side of the tablet 76 includes a horizontal score line in it. The prescription substrates 70, 72 also preferably include a bar code or other code identifying the physician to whom the booklet 10 was given.

As noted above, in the preferred embodiment of this invention two peel-off prescription substrates 70 and 72 are provided. These peel-off substrates are provided for the same purpose as described in detail in applicants' '632 application. In particular, each of the substrates is intended to be removed from the booklet and positioned on a preprinted prescription form of the physician. One of the prescriptions is intended to be given to the patient's pharmacist so that an immediate supply of the prescribed product can be obtained. The other prescription can be used by the patient to order the prescribed product through a mail order company that normally takes an extended period of time to fill and deliver the prescription (e.g., a few weeks). Thus, the first prescription substrate 70 can be used to provide an immediate few weeks supply of the product, so that the patient subsequently can avail himself or herself of the generally lower prices that can be obtained through mail order purchases of the drug.

Figure 1A:
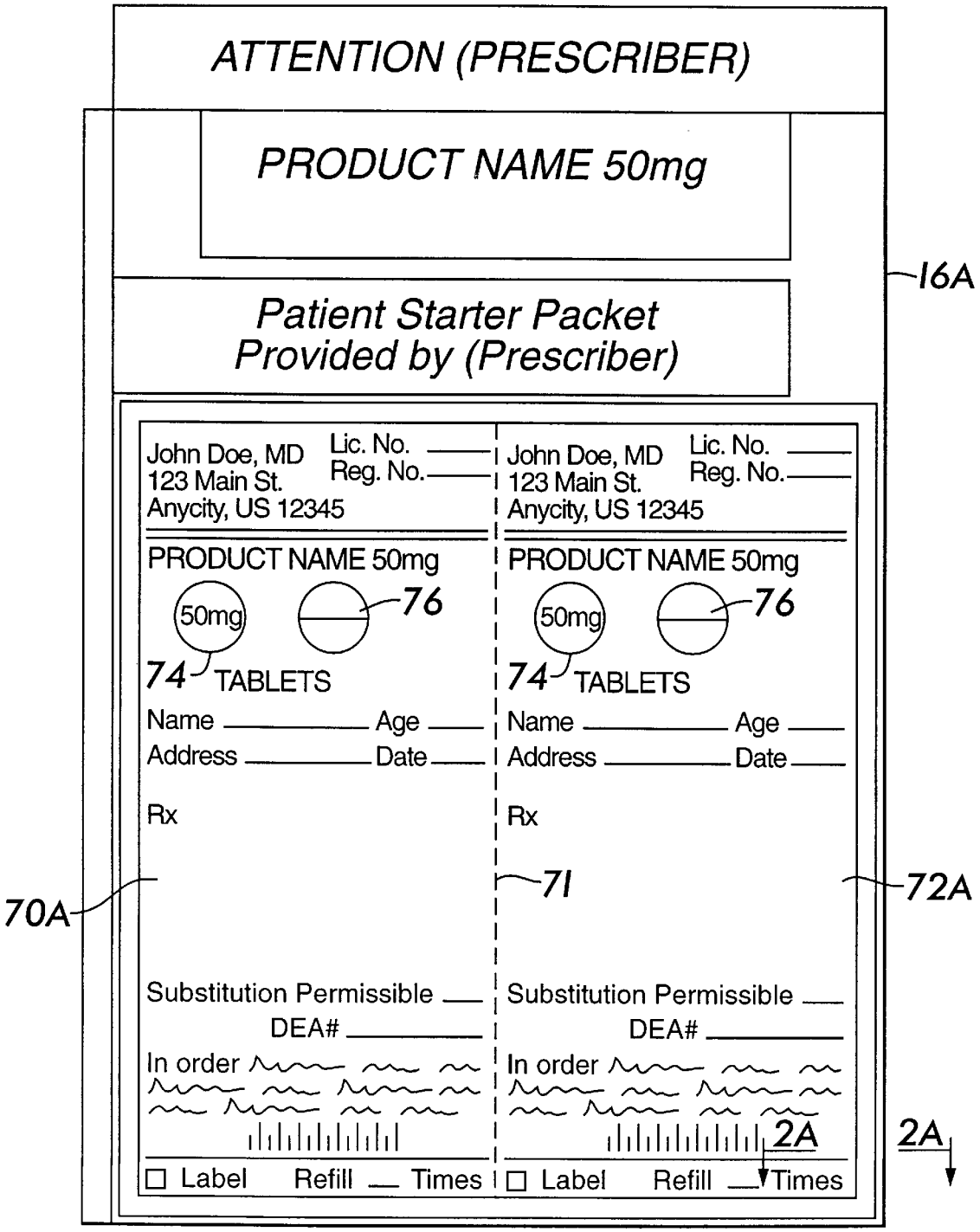
FIG. 1A is a front elevational view of a modified front cover panel of the product marketing booklet in accordance with this invention.
Figure 2A:
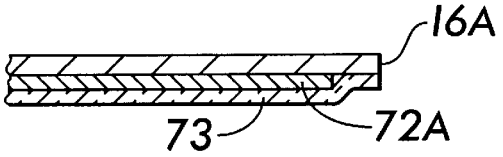
FIG. 2A is a sectional view taken along line 2A—2A of FIG. 1A.

Referring to FIGS. 1A and 2A, a modified front cover panel 16A is shown. This panel 16A differs from the panel 16 disclosed in FIG. 1 with respect to the form of the preprinted prescription substrates 70A and 72A and the manner in which those substrates are retained as part of the front cover panel 16A. In particular, in the panel 16A, each of the preprinted prescription substrates 70A and 72A are personalized, full prescription forms, which do not need to be secured to any separate prescription form of the physician or other prescriber. Second, in the illustrated embodiment these full prescription substrates are interconnected by a line of perforations 71, and a plastic film layer 73 is bonded as a top layer of the panel 16A in overlying relationship and surrounding the interconnected prescription substrates 70A and 72A to retain those substrates as part of the panel 16A. When it is desired to remove the prescription substrates 70A, 72A, the plastic film layer 73 is torn away, and the prescription substrates removed. These prescription substrates 70A, 72A are employed in exactly the same way and for exactly the same purpose as the prescription substrates 70, 72, except that the substrates 70A, 72A do not need to be attached to a separate full prescription form of the physician or other prescriber. It should be understood that the visual presentation of the medication being prescribed is included on the substrates 70A, 72A, in the same manner as described above in connection with the substrates 70 and 72.

Although the booklet 10 in accordance with the preferred embodiments of this invention includes two preprinted prescription substrates, it is within the scope of this invention to include only one substrate, if desired, and, in fact, if the product being sampled is not a prescription product, to completely omit any prescription substrate.

Referring specifically to FIG. 5, panel 18 of the outer unit 14 is foldably attached through the expanded hinge 17 to a continuous extension of the outer substrate 24 of the front panel 16. This panel 18 can include information to be communicated directly to the patient along with the product being sampled. This latter information can include part of the same information provided to the physician in the disease state management peel-off substrate 42*b* and/or in the product information peel-off substrate 40*b*. For example, and not by way of limiting the present invention, this patient information panel 18 can include information regarding any lifestyle changes/procedures that the patient should make/follow, special instructions for the patient, specific information about the product, proper procedures for using the product, precautions with respect to using the product, possible side effects and steps to be taken to deal with such side effects. The patient education segment may include color pictures of the actual product to enable the patient to carefully identify what he or she is being prescribed and dispensed. The patient also is provided with instructions as to whom to contact, preferably through the use of a toll free number, if he or she has further questions about the product or about the disease being treated.

Still referring to FIG. 5 the panels 20 and 22 are foldable relative to each other about the hinge line 21 and are separable as a single unit from the panel 18 through the line of perforations 78. The two panels 20 and 22 cooperate as a single unit to form a mailer segment 80 of the booklet. This mailer segment is to be returned to the manufacturer of the product or to a designated agent of the manufacturer, such as a data base company, as is fully described in applicants' aforementioned co-pending '730 application. As can be seen best in FIG. 2, the panels 20, 22 forming the mailer segment 80 are folded inside and adjacent to the panel 18 when the booklet 10 is in a folded, collapsed condition.

As will be explained in greater detail hereinafter the mailer segment 80 includes a front portion 80*a*, which is illustrated in FIG. 5, including certain patient and pharmacist information on it. Referring to FIG. 6, the mailer segment 80 has a rear portion 80*b* including the relevant return mail information on it. In addition, the rear portion 80*b* can include a bar code 82 identifying the physician or other person/entity to whom the booklet 10 has been given.

Referring to specifically to FIG. 5, the front portion 80a of the mailer segment 80 includes the patient information on the inner surface of panel 20 (e.g., patient's medical history/prescription history, including over-the-counter medications). This patient information is provided either by the provider of medical services (e.g., the physician) or the provider of the product (e.g., the pharmacist) or the patients themselves. Moreover, this patient information section may be computer coded for electronic scanning. A second section of the mailer segment 80 is provided by the inner surface of the panel 22 and includes instructions to the pharmacist to dispense a specified number or quantity of the product, and instructions that the quantity so dispensed will be reimbursed upon receipt by the manufacturer (or the designated agent of the manufacturer) of the return mailer segment 80 including the patient information on it. In addition to the bar code information provided on the address, or rear, side of the return mailer, the inner surface of the panel 22 can include an identification of the pharmacist and the physician, as well as dosage information.

It should be understood that the information included on the inner surfaces of the panels 20 and 22 forming the mailer 80 can be identical to the information described in applicants' co-pending '632 and '730 applications.

After removal of the mailer segment 80 along the line of perforations 78 the two panels 20 and 22 are intended to be folded into a close condition, and an adhesive stripe 86 exposed adjacent the outer edge of panel 22 by removal of a release liner therefrom (not shown) is adhered to an underlying portion of the panel 20 adjacent the line of perforations 78 to thereby maintain the panels 20 and 22 in a closed condition. This arrangement permits the panels to assume a letter-size configuration for mailing back to the addressee.

It should be understood that important information can be obtained by providing a bar code identifying the physician on the coupon or bank check, the return mailer and the prescriptions. Through use of these bar codes the manufacturer of the product, or its designated agent, can monitor the number of marketing booklets distributed by a physician, and correlate that information with the number of prescriptions being written by the physician and the number of mailers being returned by the pharmacist or by the patients. By correlating this information the manufacturer can determine, among other facts, whether a physician is indiscriminately giving away free samples without actually prescribing the product for his or her patients.

It should be understood that although a specific arrangement has been disclosed for securing the inner multi-panel unit 12 to the outer multi-panel unit 14, any other of a number of suitable interconnecting systems could be employed. The important feature is that these panels be interconnected in a position so that they can be folded into a compact collapsed condition for distribution, and so that they can provide the other benefits described herein.

It also should be understood, as set forth earlier herein, that within the broadest aspects of this invention a number of modifications can be made with respect to the information/material presented in the marketing booklet.

Without further elaboration the foregoing will so fully illustrate our invention that others may, by applying current or future knowledge, adopt the same for use under various conditions of service.

What we claim as the invention is:

1. A product marketing booklet comprising:

A. a first multi-panel unit having panels movable relative to each other between an opened condition in which the panels are spaced transversely from each other and a folded, collapsed condition in which the panels overlie each other;

B. a second multi-panel unit having panels movable relative to each other between an opened condition in which the panels are spaced transversely from each other and a folded, collapsed condition in which the panels overlie each other;

C. attachment means for removably securing said first and second units to each other with the second unit overlying at least a portion of the first unit in a position for permitting the panels of both of the first and second units to be maintained either in said opened condition, or in said folded, collapsed condition to form a multi-panel booklet.

2. The booklet of claim 1, including a front panel and a back panel provided by one of said first and second units and all of the panels of the other of said first and second units being inside panels of said booklet disposed between said front and back panels of said one of said first and second units when the panels of said first and second units are in a folded, collapsed condition.

3. The booklet of claim 1, wherein the panels of one of said first and second units include upper sections extending beyond upper edges of the panels of the other of said first and second units, said upper sections being exposed to view when the panels of both said first and second units are maintained in a folded, collapsed condition.

4. The booklet of claim 3, wherein said upper sections of one of said first and second units include indicia thereon for directing a person's attention to the panels of said one of said first and second units.

5. The booklet of claim 3, wherein said one of said units including the panels including said upper sections is vertically offset relative to the other of said units to provide said exposed upper sections.

6. The booklet of claim 2, wherein the panels of one of said first and second units include upper sections extending beyond upper edges of the panels of the other of said first and second units, said upper sections being exposed to view when the panels of both said first and second units are maintained in a folded, collapsed condition.

7. The booklet of claim 6, wherein said upper sections of one of said first and second units include indicia thereon for directing a person's attention to the panels of said one of said first and second units.

8. The booklet of claim 6, wherein said one of said units including the panels including said upper sections is vertically offset relative to the other of said units to provide said exposed upper sections.

9. The booklet of claim 6, wherein the front and back panels of said booklet are panels of said first unit and all of the panels of said second unit are inside panels, said panels of said second unit including the upper sections.

10. The booklet of claim 7, wherein the front and back panels of said booklet are panels of said first unit and all of the panels of said second unit are inside panels, said panels of said second unit including the upper sections.

11. The booklet of claim 8, wherein the front and back panels of said booklet are panels of said first unit and all of the panels of said second unit are inside panels, said panels of said second unit including the upper sections.

12. A booklet for use in marketing a medical product, said booklet comprising:

A. a first multi-panel unit having panels movable relative to each other between an opened condition in which the panels are spaced transversely from each other and a folded, collapsed condition in which the panels overlie each other, said first multi-panel unit including material to be transmitted to the user of the medical product being marketed;

B. a second multi-panel unit having panels movable relative to each other between an opened condition in which the panels are spaced transversely from each other and a folded, collapsed condition in which the panels overlie each other, said second multi-panel unit including material to be retained by the prescriber of the medical product;

C. attachment means for removably securing said first and second units to each other with the second unit overlying at least a portion of the first unit in a position for permitting the panels of both of the first and second units to be maintained either in said opened condition, or in said folded, collapsed condition to form a multi-panel booklet.

13. The booklet of claim 12, wherein a panel of said first unit includes a sample of the medical product.

14. The booklet of claim 12, wherein a panel of said first unit includes a coupon or bank check providing a discount to the purchaser of the medical product and being redeemable by the dispenser of the medical product.

15. The booklet of claim 13, wherein said panel including the sample of the medical product also includes a removable coupon or bank check providing a discount to the purchaser of the medical product and being redeemable by the dispenser of the medical product.

16. The booklet of claim 12, wherein a panel of said first unit includes educational information to be communicated to the user of the medical product.

17. The booklet of claim 16, where said education information includes information relating to the medical product and/or information relating a person's condition for which the medical product is prescribed.

18. The booklet of claim 12, wherein a pair of adjacent panels of the first unit is removably formed as part of said first unit and is a mailer intended to be transmitted to a provider of the product, said mailer including areas to be completed with information relating to the intended user of the product.

19. The booklet of claim 18, wherein the information relating to the intended user of the product includes information relating to the medical and/or prescription history of said intended user.

20. The booklet of claim 12, wherein a panel of said second unit includes a substrate with information relating to the product.

21. The booklet of claim 12, wherein a panel of said second unit includes a substrate with information relating to the treatment of a condition for which said medical product is employed.

22. The booklet of claim 20, wherein said substrate is removable from said second unit and is attachable to a member external of the booklet.

23. The booklet of claim 21, wherein said substrate is removable from said second unit and is attachable to a member external of the booklet.

24. The booklet of claim 12, wherein a first panel of said second unit includes a substrate with information relating to the medical product and a second panel of said second unit includes a substrate with information relating to the treatment of a condition for which said medical product is employed.

25. The booklet of claim 24, wherein said substrates of said first and second panels are removable from said second unit and are attachable to a member external of the booklet.

26. The booklet of claim 22, wherein said member external of the booklet is a medical chart of a patient for whom the medical product is prescribed.

27. The booklet of claim 23, wherein said member external of the booklet is a medical chart of a patient for whom the medical product is prescribed.

28. The booklet of claim 25, wherein said member external of the booklet is a medical chart of a patient for whom the medical product is prescribed.

29. The booklet of claim 12, wherein a panel of said second unit includes a substrate with formulary information relating to which health care insurers/providers will reimburse for the cost of the medical product.

30. The booklet of claim 29, wherein said substrate is removable from said second unit and is attachable to a member external of the booklet.

31. The booklet of claim 30, wherein said member external of the booklet is a medical chart of a patient for whom the medical product is prescribed.

32. The booklet of claim 12, wherein a first panel of said second unit includes a substrate with information relating to the medical product, a second panel of said second unit includes a substrate with information relating to the treatment of a condition for which said medical product is employed, and a third panel of said second unit includes a substrate with formulary information relating to which health care insurers/providers will reimburse for the cost of the medical product.

33. The booklet of claim 32, wherein said substrates of said first, second and third panels are removable from said second unit and are attachable to a member external of the booklet.

34. The booklet of claim 33, wherein said member external of the booklet is a medical chart of a patient for whom the medical product is prescribed.

35. The booklet of claim 12, wherein said first unit includes panels providing a front panel and a back panel of said booklet and all of the panels of the second unit being inside panels of said booklet disposed between said front and back panels of said first unit when the panels of said first and second units are in a folded, collapsed condition.

36. The booklet of claim 12, wherein the panels of the second unit include upper sections extending beyond upper edges of the panels of the first unit, said upper sections being exposed to view when the panels of both said first and second units are maintained in a folded, collapsed condition.

37. The booklet of claim 36, wherein said upper sections of the panels of said second unit include indicia thereon for directing a person's attention to the panels of said second unit.

38. The booklet of claim 36, wherein the second unit including the panels with said upper sections is vertically offset relative to the first unit to provide said exposed upper sections.

39. The booklet of claim 35 wherein the panels of the second unit include upper sections extending beyond upper edges of the panels of the first unit, said upper sections being exposed to view when the panels of both said first and second units are maintained in a folded, collapsed condition.

40. The booklet of claim 39, wherein said upper sections of said second unit include indicia thereon for directing a person's attention to the panels of said second unit.

41. The booklet of claim 39, wherein the second unit including the panels with said upper sections is vertically offset relative to the first unit to provide said exposed upper sections.

42. The booklet of claim 12, wherein said first unit includes at least one, removable, prescription member, said member including a visual presentation of the appearance of the product being prescribed.

43. The booklet of claim 42, wherein said visual presentation includes a presentation of the actual size and color of the product, including any surface indicia thereon.

44. The booklet of claim 42, wherein the product being prescribed has opposed top and bottom surfaces and said visual presentation includes a presentation of the actual size and color of the product, including all surface indicia on each of said top and bottom surfaces.

45. The booklet of claim 42, wherein said at least one removable prescription member includes preprinted indicia identifying the product being prescribed by name and dosage, and identifying the manner in which the product should be taken by the user.

46. The booklet of claim 45, wherein said preprinted indicia further includes an area for identification of the quantity of the prescribed product, said area to be manually filled in by the prescriber of the product.

47. The booklet of claim 45, wherein said visual presentation includes a presentation of the actual size and color of the product, including any surface indicia thereon.

48. The booklet of claim 45, wherein the product being described has opposed top and bottom surfaces and said visual presentation includes a presentation of the actual size and color of the product, including all surface indicia on each of said top and bottom surfaces.

49. A booklet for use in marketing a medical product, said booklet comprising:

A. a first multi-panel unit having panels movable relative to each other between an opened condition in which the panels are spaced transversely from each other and a folded, collapsed condition in which the panels overlie each other, said first multi-panel unit including a coupon or bank check providing a discount to the purchaser of the medical product and being redeemable by the dispenser of the medical product, at least one removable, prescription member, and a pair of adjacent panels removably formed as part of said first unit and constituting a mailer intended for transmission to a provider of the product, said mailer including areas to be completed with information relating to the intended user of the product B. a second multi-panel unit having panels movable relative to each other between an opened condition in which the panels are spaced transversely from each other and a folded, collapsed condition in which the panels overlie each other, said second multi-panel unit including material to be retained by the prescriber of the medical product;

C. attachment means for removably securing said first and second units to each other with the second unit overlying at least a portion of the first unit in a position for permitting the panels of both of the first and second units to be maintained either in said opened condition, or in said folded, collapsed condition to form a multi-panel booklet; and D. said coupon or bank check, prescription member(s), and mailer each including indicia identifying the entity to whom the booklet was distributed.

50. A prescription device including information to be communicated by a health care provider to a patient in order to permit the patient to receive a prescribed quantity of a pharmaceutical product, said device including a substrate sized to include on a front surface thereof necessary indicia for permitting a dispenser of the product to fill the prescription, said indicia including information identifying the dosage amount and frequency of administration of the product, the quantity of product to be dispensed to the patient, the name and strength of the product to be dispensed to the patient and a visual presentation of the appearance of the product being prescribed, said visual presentation of the appearance of the product and at least some other of said indicia being preprinted on said substrate.

51. The prescription device of claim 50, wherein said visual presentation includes a presentation of the actual size and color of the product, including any surface indicia thereon.

52. The prescription device of claim 50, wherein the product being prescribed has opposed top and bottom surfaces and said visual presentation includes a presentation of the actual size and color of the product, including all surface indicia on each of said top and bottom surfaces.

53. The prescription device of claim 50, wherein said preprinted indicia further includes an area for identification of the quantity of the prescribed product, said area to be manually filled in by the prescriber of the product.

54. The prescription device of claim 50, wherein said substrate is sized for receipt on a prescription form of the health care provider, said substrate including an adhesive on a rear surface thereof for attachment to said prescription form.

55. A marketing device for marketing a medical product, said device including:

A. a first unit including the medical product, which is to be given to a user therof;

B. a second unit to be retained by the prescriber of the medical product, said second unit including information relating to the medical product; and C. attachment means for removably retaining the second unit to the first unit with a marginal section of the second unit spaced beyond an adjacent edge of the first unit to expose said marginal section to view by the prescriber of the medical product.

56. The marketing device of claim 55, wherein the marginal section of the second unit includes indicia advising the prescriber that the second unit is for the prescriber's use and should be removed from the first unit.

57. The marketing device of claim 55, wherein the second unit includes a peel-off substrate with information relating to the medical product, said peel-off substrate including an adhesive surface for attachment to a medical chart of a user of the product.

* * * * *